US009565886B2

(12) United States Patent
Bird

(10) Patent No.: US 9,565,886 B2
(45) Date of Patent: Feb. 14, 2017

(54) PROTECTIVE HEADGEAR

(71) Applicant: Gregory Francis Bird, Milwaukee, WI (US)

(72) Inventor: Gregory Francis Bird, Milwaukee, WI (US)

( * ) Notice: Subject to any disclaimer, the term of this patent is extended or adjusted under 35 U.S.C. 154(b) by 333 days.

(21) Appl. No.: 14/102,078

(22) Filed: Dec. 10, 2013

(65) Prior Publication Data

US 2014/0157498 A1 Jun. 12, 2014

Related U.S. Application Data

(60) Provisional application No. 61/735,357, filed on Dec. 10, 2012, provisional application No. 61/829,361, filed on May 31, 2013.

(51) Int. Cl.

| | |
|---|---|
| ***A42B 3/06*** | (2006.01) |
| ***A42B 3/04*** | (2006.01) |
| *A41D 13/05* | (2006.01) |

(52) U.S. Cl.

CPC ..... *A42B 3/063* (2013.01); *A42B 3/0473* (2013.01); *A42B 3/06* (2013.01); *A42B 3/069* (2013.01); *A41D 13/0512* (2013.01)

(58) Field of Classification Search

CPC ..... A42B 3/0473; A42B 3/06; A42B 3/063; A42B 3/069; A42B 3/12; A41D 13/0512

USPC ..... 2/425, 459

See application file for complete search history.

(56) References Cited

U.S. PATENT DOCUMENTS

| | | | | |
|---|---|---|---|---|
| 1,021,804 | A | 1/1912 | Schneider | |
| 3,242,500 | A | 3/1966 | Derr | |
| 3,879,761 | A | 4/1975 | Bothwell | |
| 3,991,421 | A | 11/1976 | Stratten | |
| 4,424,736 | A | 1/1984 | Byrne | |
| 4,825,469 | A | 5/1989 | Kincheloe | |
| 4,999,855 | A * | 3/1991 | Brown | A42B 3/0473 2/421 |
| 5,261,125 | A | 11/1993 | Cartwright et al. | |
| 5,295,271 | A * | 3/1994 | Butterfield | A42B 3/0473 2/410 |
| 5,353,437 | A | 10/1994 | Field et al. | |
| 5,444,870 | A | 8/1995 | Pinsen | |
| 5,517,699 | A | 5/1996 | Abraham | |
| 5,546,601 | A | 8/1996 | Abeyta | |
| 5,581,816 | A | 12/1996 | Davis | |
| 5,715,541 | A | 2/1998 | Landau | |
| 5,794,270 | A | 8/1998 | Howat | |
| 5,896,590 | A | 4/1999 | Fleisch | |
| 5,930,843 | A | 8/1999 | Kelly | |
| 6,052,835 | A * | 4/2000 | O'Shea | A42B 3/0473 2/425 |

(Continued)

FOREIGN PATENT DOCUMENTS

WO 2013159124 A1 10/2013

*Primary Examiner* — Katherine Moran

(74) *Attorney, Agent, or Firm* — Andrus Intellectual Property Law, LLP

(57) ABSTRACT

A head protection system includes an elastomeric cap configured to be held in a position relative to a crown of the head of the wearer. A torus-shaped cushioning chamber is positioned between an outer surface of the elastomeric cap and the head of the wearer. A plurality of cage slats extend from the elastomeric cap between the elastomeric cap in a position relative to the crown of the head of the wearer and protect the head of the wearer from impact.

18 Claims, 14 Drawing Sheets

(56) References Cited

U.S. PATENT DOCUMENTS

| | | | | |
|---|---|---|---|---|
| 6,253,389 | B1 | 7/2001 | Scaglione | |
| 6,385,781 | B1 * | 5/2002 | Rose | A42B 3/00 2/421 |
| 6,397,402 | B1 | 6/2002 | Holland et al. | |
| 6,434,756 | B1 | 8/2002 | Hoop | |
| 6,539,556 | B1 | 4/2003 | Barker | |
| 6,588,022 | B1 | 7/2003 | Anders et al. | |
| 6,591,430 | B1 | 7/2003 | Sledge | |
| 6,971,123 | B2 | 12/2005 | Weaver | |
| 7,051,379 | B2 | 5/2006 | Lambert | |
| 7,120,941 | B2 | 10/2006 | Glaser | |
| 7,328,462 | B1 * | 2/2008 | Straus | A42B 3/067 2/411 |
| 7,703,152 | B2 | 4/2010 | Rhodes et al. | |
| 7,849,525 | B2 | 12/2010 | Ghajar | |
| 7,874,239 | B2 | 1/2011 | Howland | |
| 8,276,217 | B1 | 10/2012 | Hamilton | |
| 8,782,819 | B1 * | 7/2014 | Culpepper | A42B 3/10 2/410 |
| 8,918,918 | B2 | 12/2014 | Jackson | |
| 2006/0096010 | A1 | 5/2006 | Glaser | |
| 2006/0260027 | A1 | 11/2006 | Rhodes et al. | |
| 2011/0162131 | A1 | 7/2011 | Harty | |
| 2012/0278980 | A1 | 11/2012 | Chuback | |
| 2013/0263728 | A1 | 10/2013 | Hebensperger et al. | |

* cited by examiner

PROTECTIVE HEADGEAR

CROSS-REFERENCE TO RELATED APPLICATION

The present application claims priority of U.S. Provisional Patent Application No. 61/735,357 filed on Dec. 10, 2012 and U.S. Provisional Application No. 61/829,361 filed on May 31, 2013, the contents of which are both incorporated herein by reference in their entireties.

BACKGROUND

The present disclosure is related to the field of protective headgear. More specifically, the present disclosure is related to protection of the head and neck from injury due to forcible impacts.

Standard components of existing shoulder pad systems include padding and exterior impact panels and methods to secure the shoulder pad systems to the wearer. These components are flexibly connected to allow articulation of a wearer's body parts. Such a wearer may be a participant in a sporting contest that includes a risk for collisions or impacts. However, such protective components may also be used in the context of industrial or military uses which may also carry risks of collision or impact.

Head protection is an ongoing, problem in various fields, two examples of which include military combat and professional and amateur sports. Popular professional or amateur sports include American football, ice hockey, martial arts, lacrosse, field hockey, motor sports, etc. which all have the same rising incidences of concussions among players. Similar concerns of head and neck protection are present in military, industrial, and construction work settings.

Recent innovations have focused on expanding the space between the inside of a helmet shell and the head of the wearer, improving helmet surface collision effect, looser helmet fit, improved materials, soft exterior helmet layers, and brain circulation modifications directed for absorbing and dissipating impacts to the head. Despite these innovations, head and neck injuries continue in the aforementioned environments raising public and wearer awareness of head injury consequences with each new publicized injury associated with behavior problems and increased suicide rates, which can degrade willingness to serve for national security, and to engage in otherwise healthful sports which threaten the traditions and economic vitality of long standing and popular entertainment industries.

BRIEF DISCLOSURE

An embodiment of a head protection system includes at least one shoulder pad configured to secure to the shoulders of a wearer. An elastomeric cap is configured to be held, in a position relative to a crown of the head of the wearer. A torus-shaped cushioning chamber is positioned between the outer surface of the elastomeric cap and the head of the wearer. A plurality of cage slats extend between at least one shoulder pad and the elastomeric cap. The plurality of cage slats maintain the elastomeric cap in the position relative to the crown of the head of the wearer and protect the head of the wearer from impact.

An embodiment of head protection system includes a shoulder pad configured to secure about the shoulders of a wearer. A tight fitting cap is configured to be securely worn about the head of the wearer. An elastomeric cap is configured to be resiliently held in a position relative to the tight fitting cap. A tether resiliently secures the tight fitting cap to the elastomeric cap. A torus-shaped cushioning chamber is positioned between an out surface of the elastomeric cap and the tight fitting cap. A resilient sheet is secured to the outer surface of the elastomeric cap. A plurality of cage slats extend radially away from the elastomeric cap to the shoulder pad in a recurved shape about the tight fitting cap.

An embodiment of a protective headgear includes a tight fitting cap configured to be securely worn about the head of a wearer. An elastomeric cap is configured to be resiliently held, in a position relative to the tight fitting cap. A tether resiliently secures the tight fitting cap to the elastomeric cap. A torus-shaped cushioning chamber is positioned between an outer surface of the elastomeric cap and the tight fitting cap. A resilient sheet is secured to the outer surface of the elastomeric cap. A plurality of cage slats extend radially away from the elastomeric cap in a recurved shape about the tight fitting cap. A plurality of mounts are configured to each secure an end of one of the plurality of cage slats to the shoulder pad. Each of a plurality of nodes is configured to secure one of the plurality of cage slats to the shoulder pad.

DETAILED DISCLOSURE

The system and apparatus as disclosed herein seeks to improve head and neck impact protection by centering the head and neck in a resilient impact-absorbing shoulder pad and head mounted cage assembly. The head cage and shoulder pad assembly are constructed such that the wearer's head does not contact the slats of the cage assembly about the wearer's head.

Figure 1:
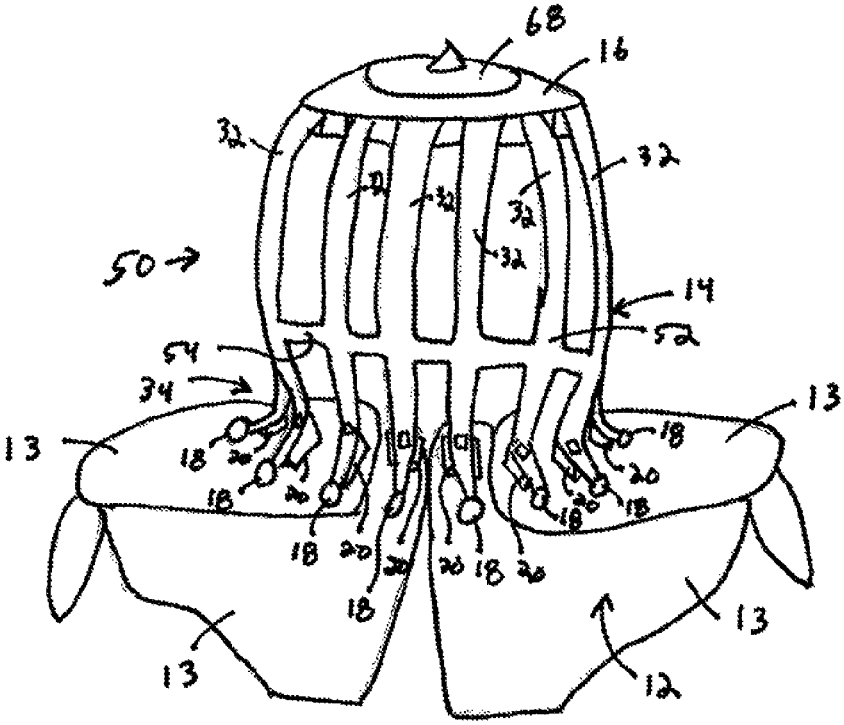
FIG. 1 depicts an embodiment of a head protection system.

FIG. 1 depicts an exemplary embodiment of the head protection system 10 as disclosed in greater detail herein. The head protection system 10 has the basic components of shoulder pads 12, a head cage assembly 14, and a cap 16. The shoulder pads 12 may be similar to standard components of existing shoulder pad systems and therefore include means for attachment of shoulder pads 12 to wearer, padding and exterior rigid panels 13 attached to padding sections that are flexibly connected to allow articulation of body parts of the wearer. The shoulder pads 12 are modified in the manner as described in further detail herein to include a series of mounts 18 and nodes 20 configured to secure the head cage assembly 14 to the shoulder pad 12 at rigid panels 13. The head cage assembly 14 is constructed of a series of cage slats 32. The cage slats 32 of the head cage assembly 14 are mounted to the shoulder pads 12 at their lower ends and mounted to the cap 16 at their upper ends.

Figure 2:
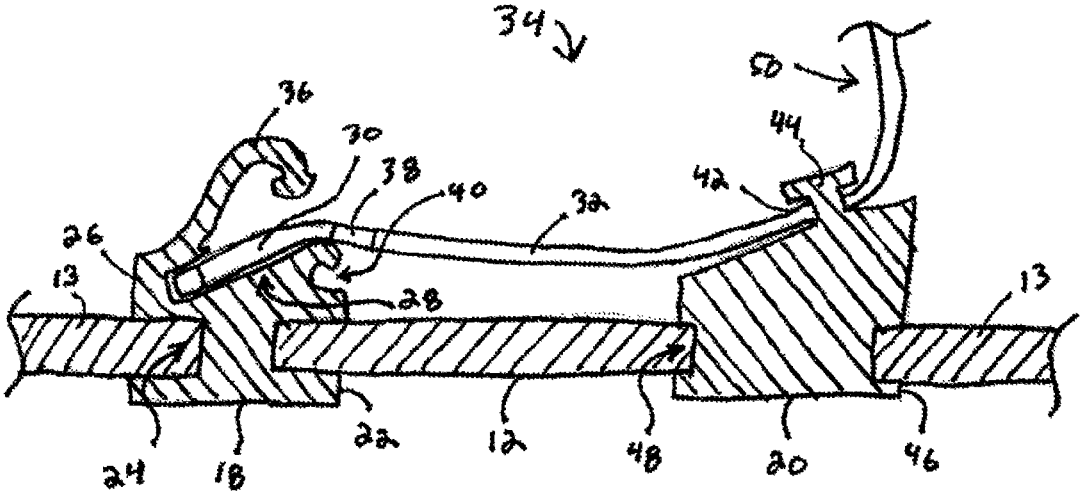
FIG. 2 depicts a cross sectional view of an embodiment of a mount, node, and cage slat lower portion.

FIG. 2 depicts a side sectional view of an embodiment of a mount 18 and a node 20 connected to the rigid panels 13 of the shoulder pads 12. In the embodiment, an elastomeric mount 18 is resiliently connected to the rigid, panels 13 of the shoulder pads 12 by insertion of a wearer side 22 of the mount 18 through a through hole 24 in the rigid panels 13 of the shoulder pads 12 such that the elastomeric mount 18 fits securely in the through hole 24. The wearer side 22 of the mount 18 is wide enough to dissipate shock over a non-point area so as to prevent injury from penetrating impact to a point on the wearer body beneath the shoulder pads 12. In some embodiments, the wearer side 22 of the mount 18 may correspond to a void in the underlying padding (not depicted) where necessary to limit penetrating impact. The mount 18 further includes an outer side 26 which forms a seat 28 that is configured to receive a lower end tab 30 of a cage slat 32. As depicted in FIG. 1, a plurality of cage slats 32 form the head cage assembly 14 of the head protection system 10 as disclosed herein. Returning back to FIG. 2, the portion of the cage slat 32 shown in FIG. 2 represents an embodiment of a cage slat lower portion 34. The mount 18 and lower end tab 30 are constructed in a manner such that these components possess a material strength sufficient to prevent penetrating injury to a point on the body through the through hole 24. In an embodiment each of the cage slat lower portions 34 engaged at the mounts 18 and nodes 20 are uniformly constructed such that cage slat lower portions 34 of cage slats 32 are interchangeable on each cage slat 32 allowing cage slats 32 with damaged cage slat lower portions 34 to be removed and replaced with intact cage slat lower portions 34 which facilitates field modifications or repairs. In an embodiment, each of the cage slat lower portions 34 engaged at the mounts 18 and nodes 20 are uniformly constructed such that cage slat lower portions 34 of cage slats 32 are interchangeable on each cage slat 32 which facilitates field modifications or repairs.

Figure 3A:
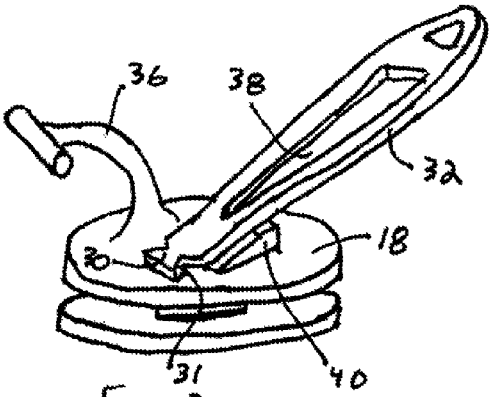
FIG. 3A depicts a cage slat engaged with a mount.
Figure 3B:
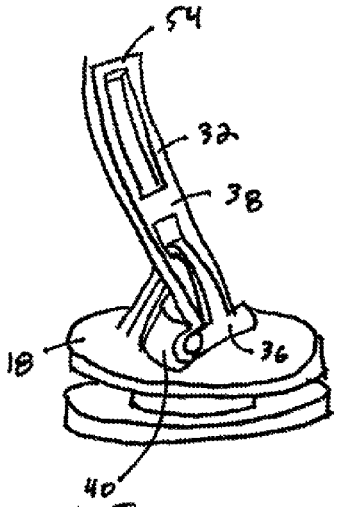
FIG. 3B depicts a cage slat engaged with a mount with a T-shaped locking bar locked.

As best depicted in FIGS. 3A and 3B, the lower end tab 30 is constructed with a widened portion 31 that fits resiliently and correspondingly within the seat 28. A flexible T-shaped locking bar 36 that may be constructed as an integral part of the mount 18 is designed to flexibly and releasably engage the cage slat lower portion 34 of the cage slat 32 at a position above the lower end tab 30. In a non-limiting embodiment, the T-shaped locking bar 36 engages a through hole 38 in the cage slat lower portion 34 of the cage slat 32. In some embodiments, through holes 38 may be keyed or have a specialized shape or dimension. Once passing through the through hole 38, the T-shaped locking bar 36 engages a resilient lock 40 that secures the lower end tab 30 within the seat 28 of the mount 18. In still further embodiments, while not depicted, the mount 18 may further include other resilient locks that further engage and secure the T-shaped locking bar 36 or other structure of the mount 18 to the cage slat lower portion 34.

Figure 3C:
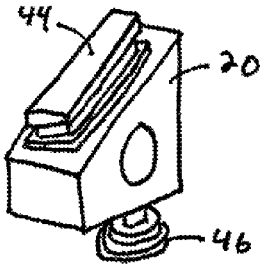
FIG. 3C depicts an embodiment of a node.
Figure 3D:
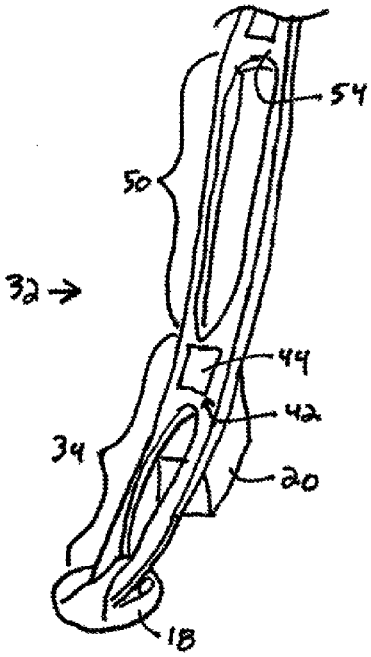
FIG. 3D depicts an embodiment of a mount, a node, and a cage slat lower portion.

Referring now to FIGS. 2 and 3C, the cage slat lower portion 34 further includes a key hole 42 configured to receive a key 44 of the node 20. The node 20 includes a wearer side portion 46 which is secured to the shoulder pads 12 rigid panels 13 through a through hole 48 so as to maintain the node 20 in a fixed position with respect to the mount 18. This keeps the cage slat lower portion 34 within a default set distance from the shoulder pads 12 rigid panels 13 both under default conditions and resiliently limited movement under impact which helps to maintain a stronger interlocking support for the cage slat lower portion 34 to the shoulder pads 12 rigid panels 13 and contributes to the overall head protection system 10 suspension and impact dampening. The cage slat lower portion 34 is configured so that the cage slat lower portion 34 and the cage slat center portion 50 creates a curve and recurve system that facilitates the suspension and dampening of impact forces on the head cage assembly 14, and in particular, on the cage slat center portion 50, so as to protect the wearer's head from contacting head cage assembly 14.

In another embodiment, the position on the rigid panels 13 of the shoulder pads 12 in which the mounts 18 and nodes 20 are connected are reversed. In such an embodiment (not depicted), the mounts 18 are closer to the wearer's head and inside the head cage assembly 14. In a still further embodiment, the nodes 20 may also be resiliently connected to one another to strengthen the connection between individual nodes 20 and the shoulder pads 12, and also to create a greater resilient mass to absorb impacts.

Embodiments of the mounts 18 or nodes 20 which may also be resiliently connected to one another may be constructed of a respectively unitary design and exemplarily may be molded in a keyed fashion such that only similarly keyed end tabs 30 will be received within the mount 18. In one embodiment of molding the elastomeric components, during injection of the elastomer melt, when the mold is full, a smooth metal pin (or another non-limiting example of a reinforcing structure) is inserted into the soft melt so as to be centered in the "T" of the T-shaped locking bar 36 and completely surrounded by the elastomer, thus creating an elastomeric T-shaped locking bar 36 that has the resiliency of an elastomer, while having the strength in the "T" of the locking bar 36 of the reinforcement. The T-shaped locking bar 36 is tethered to the body of the elastomeric mount 18 such that the T-shaped locking bar 36 can be inserted behind a locking cradle 40 that forms the outer portion of the mount 18 adjacent to the wearer side face of the cage slat lower portion 34 and the elastomeric mount 18 keyed bushing adjacent to the outer surface of rigid panels 13 of the shoulder pads 12.

Referring back to FIG. 1, in an embodiment, the cage slat center portion 50 in non-limiting examples is similar in sectional dimension, construction, and performance to existing athletic helmet face cages and provides the area for wearer viewing. The cage slat center portion 50 includes vertical slats 52 and connecting slats 54 to provide maximum wearer viewing while preventing penetration (in some athletic applications) by fingers and game equipment and to strengthen and complete head cage assembly 14 performance by maintaining the spacing between cage slats 32 forming head cage assembly 14. The cage slat center portions 50 may be connected and interconnected horizontally (similar to existing helmet face cages), or, connected with elastomeric materials facilitating movable connectivity between the cage slat center portions 50 within construction of head cage assembly 14 to maintain a predetermined safe cage slat 32 spacing with ends of the cage slat center portions 50 vertical slats 52 joining the cage slat lower portion 34 and a cage slat upper portion 56. In some embodiments, as may be exemplarily used for ice hockey applications, connecting slats at other angles rather than horizontal or vertical may be used such as to create a zig-zag pattern or other patterns as may be recognized by a person of ordinary skill in the art such as to keep stick blades, stick handles, or pucks exterior to the head cage assembly 14 (not shown). The cage slat vertical slats 52 and horizontal slats 54 may in non-limiting examples be constructed by metal, thermal plastics, including transparent and/or translucent thermal plastics. In still further embodiments, the slats may in non-limiting examples be fitted to allow for the attachment of penetration protecting netting or panels, ballistic armor panels, and/or reflective and/or display surfaces.

Figure 4A:
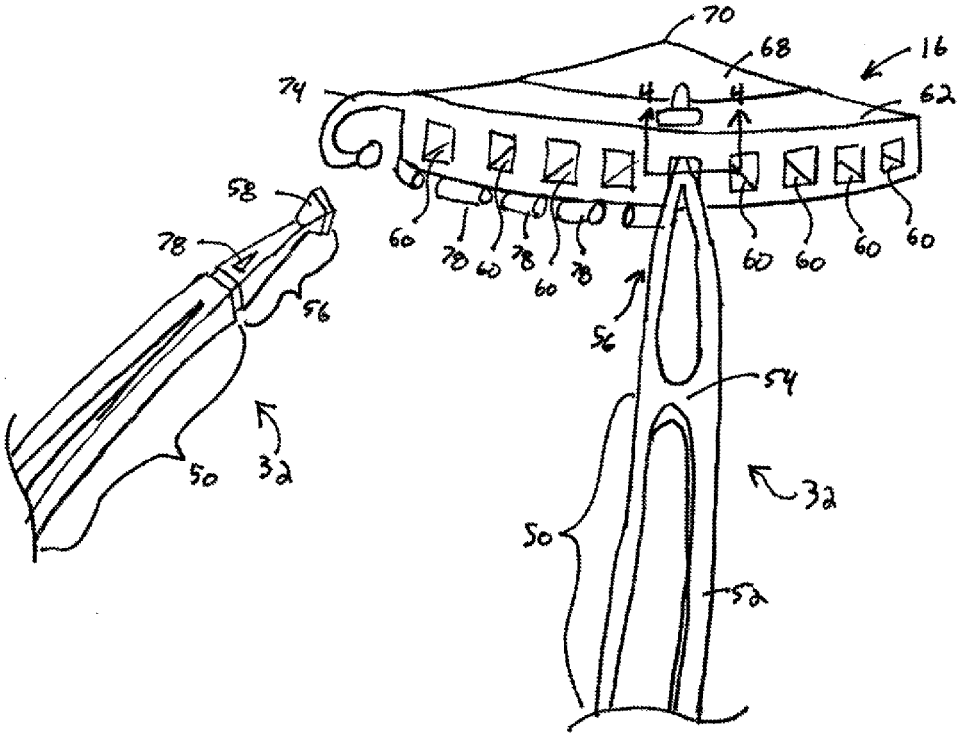
FIG. 4A depicts a side view of an embodiment of a cap and cage slat upper portion.
Figure 8:
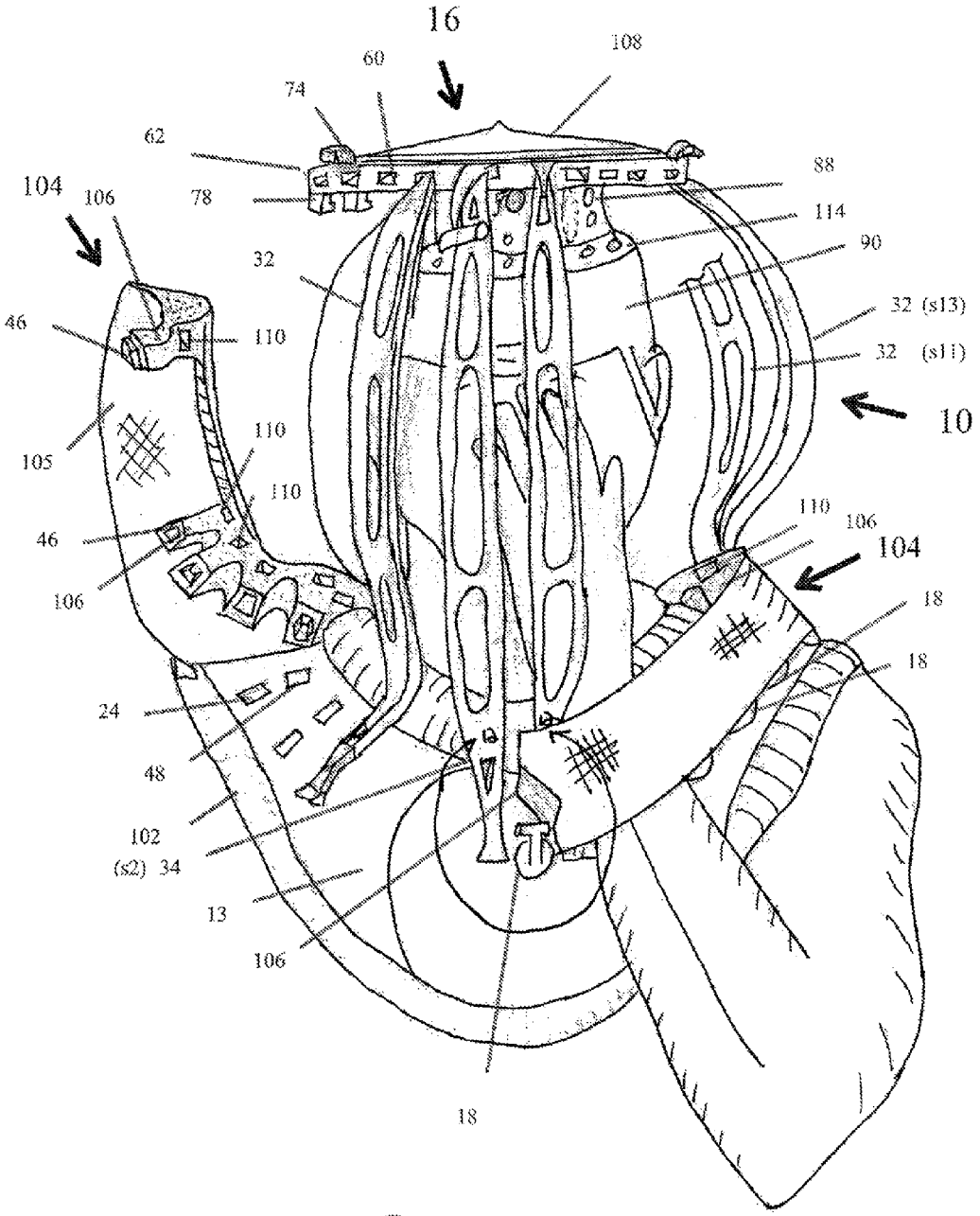
FIG. 8 is an additional partial front view of the embodiment of the elastomeric cap and cover of FIG. 7.

As shown in FIG. 4A, uniform and interchangeable (which facilitates field modifications or repairs) cage slat upper portions 56 join tapering ends of the slat cage center portion 50 vertical slats 52. The slat cage upper portion 56 is configured with a tapered end tab 58 that is configured to fit into a seat 60 in a radially-chambered elastomeric cap 62. In some embodiments, the cage slats 32 each may be unitary in construction, while in other embodiments the lower 34, center 50 and upper 56 portions are separate pieces and secured to one another. While the cage slats 32 may be of a unitary solid construction, as shown in FIG. 4A and FIG. 8, in an alternative embodiment at least the center portion 50 of the cage slats 32 may be constructed with two or more vertical slats 52 separated by a space or gap.

Figure 4B:
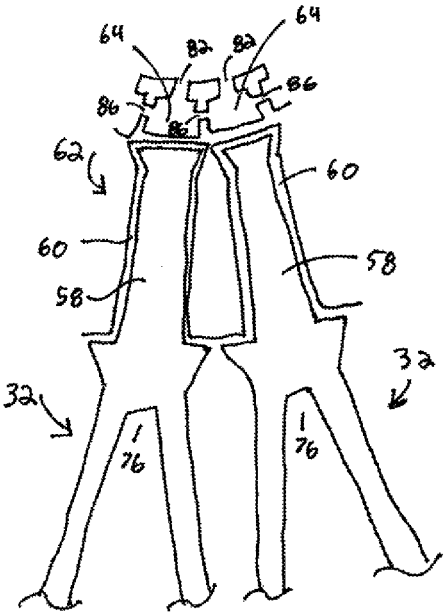
FIG. 4B depicts a partial cross sectional view taken along line 4-4 in FIG. 4A.

FIG. 4B is a partial cutaway view taken along line 4-4 in FIG. 4A which depicts the end tab 58 radially extending into the seat 60 and the elastomeric cap 62 which includes radially alternating seats 60 and air chambers 64. Some embodiments of the air chamber 64 may include baffles (not depicted) disposed within the air chambers 64 such as to facilitate the direction of air as described in more detail herein. In still other embodiments, the air chambers may be located radially interior of the seats.

Referring now to FIGS. 4A and 4B, the cap 16 includes the elastomeric cap 62 and a resilient sheet 68 that is formed into a cone or a cone with a non-sharp, or rounded, point 70 so as to deflect head cage 14 from sticking or locking to an object impacting the head cage assembly 14 at the crown. In non-limiting embodiments, the resilient sheet is constructed of a resin, epoxy, or polymer, while in other embodiments, the resilient sheet is constructed of a metal such as, but not limited to stainless steel bonded to elastomer of elastomeric cap 62. The radially arranged seats 60 in the sides of the elastomeric cap 62 are configured to receive the end tabs 58 of the cage slat upper portion 56. The end tabs 58 terminate in a widened end portion 72 that resiliently and correspondingly hold the end tabs 58 into the seat 60. Additionally, T-shaped locking bars 74 extend from the top outer edge of the elastomeric cap 62 centered above the seats 60 opening top edges and are received through a through hole 76 in the cage slat upper portion 56. T-shaped locking bars 74 may be similar in design and construction to T-shaped locking bars 36, described above. The T-shaped locking, bars 74, once positioned through the through holes 76, resiliently lock to a tether lock 78 on the underside of the elastomeric cap 62. Thus, the end tabs 58 are secured within the seat 60 of the elastomeric cap 62 in a manner to resiliently move within the elastomeric cap 62 so as to return to a default position after receiving an impact. The connection of the end tabs 58 with the elastomeric cap 62 further assist in restoring the head cage assembly 14 to its default shape after an impact.

Figure 4C:
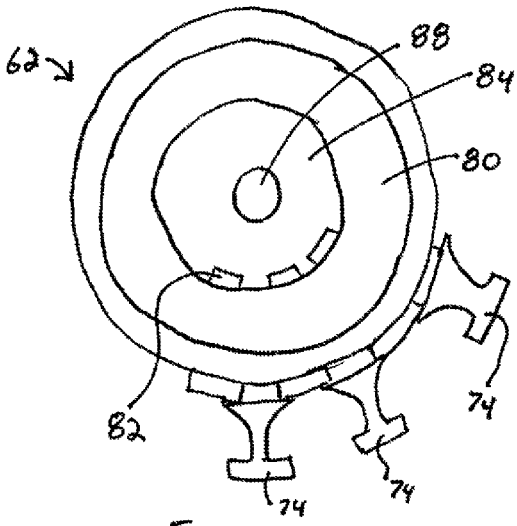
FIG. 4C is a bottom view of an embodiment of an elastomeric cap.

FIG. 4C is a bottom view of the elastomeric cap 62. The elastomeric cap 62 includes a plurality of radially extending T-shaped locking bars 74 located as described herein. While only a few locking bars 74 are depicted, it will be understood that in embodiments such locking bars extend all the way around the elastomeric cap 62 corresponding with each cage slat 32. From the bottom view of the elastomeric cap 62, a torus-shaped cushioning chamber 80 can be seen. The torus-shaped cushioning chamber 80 extends in a ring about the elastomeric cap 62 on the bottom or wearer side. The torus-shaped cushioning chamber 80 interacts with the air chamber 64 (shown in FIG. 4B) in a manner described herein such as to selectively fill and empty with air to create a cushion for the dissipation of impacts to the crown of a wearer's head.

Each of the air chambers 64 terminates in a breathing port 82 that is directed radially interior of the torus cushioning chamber 80, which opens to tether storage area 84, as will be described in further detail herein. Adjacent air chambers 64 are pneumatically connected by inflate ports 86, as described in further detail herein. In embodiments, the torus-shaped cushioning chamber 80 may be a single open chamber that is pneumatically connected to each of the series of air chambers 64, or in alternative embodiments, the torus-shaped cushioning chamber 80 may be a series of individual torus arc segment-shaped chambers (112 shown in FIG. 9) that are each associated with, and pneumatically connected to, one of the air chambers 64.

A tether 88 is connected to the underside of the cap 16. The tether 88 resiliently connects the elastomeric cap 62 to a tight-fitting helmet 90 (FIG. 6) tailored to the wearer's head. As a non-limiting example, the tight-fitting helmet 90 may be in the form of a modified "scrum cap" as worn by rugby players. The tether 88 connects the center of the wearer side of the elastomeric cap 62 to the tight-fitting helmet 90 holding the wearer's head in a way that centers the wearer's head in alignment both within the head protection system 10 and axially in alignment with the cap 16. The tether 88 is configured to allow normal range of rotational movement of the wearer's head, including side-to-side and up and down rotation head movements; however, limiting longitudinal movement of the head in order to maintain the head centered within the head cage assembly 14 to protect head and neck from damaging hyperextension.

Figure 5:
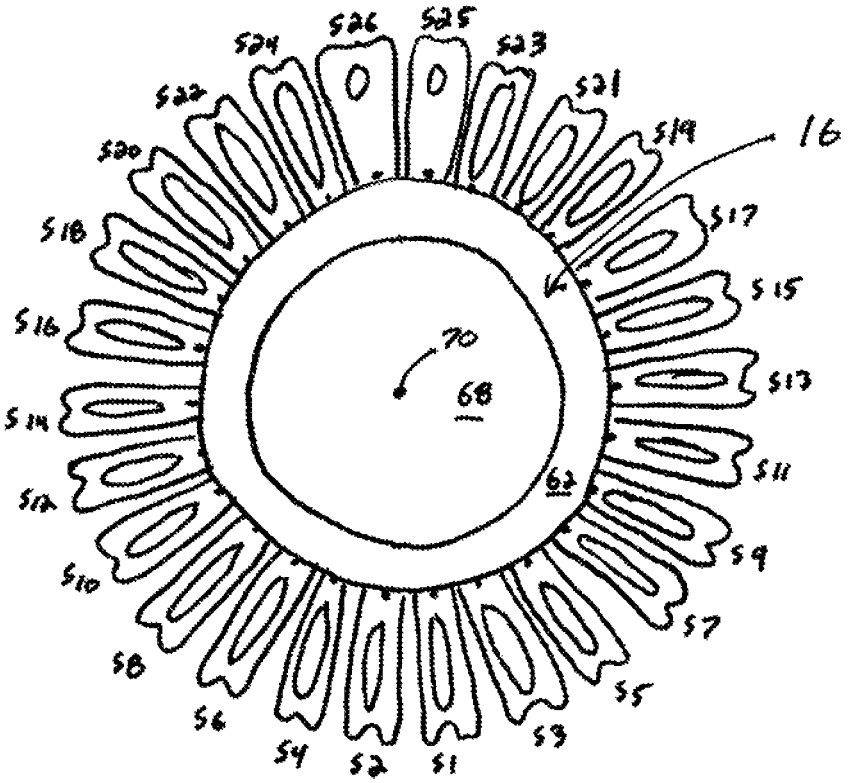
FIG. 5 is a top view of an embodiment of an elastomeric cap connected to a plurality of slats.

FIG. 5 depicts a top view of the cap 16 from which a plurality of slats (S1-S26 radially extend as described above. In some embodiments, a back side of the head protection system 10 has additional reinforced support connections and cage slats 32 (FIGS. 8, S25 and S26) to the shoulder pads 12 rigid panels 13 to stiffen the cage assembly 14 from extreme angular and high head-level impacts, especially from the rear.

Figure 6:
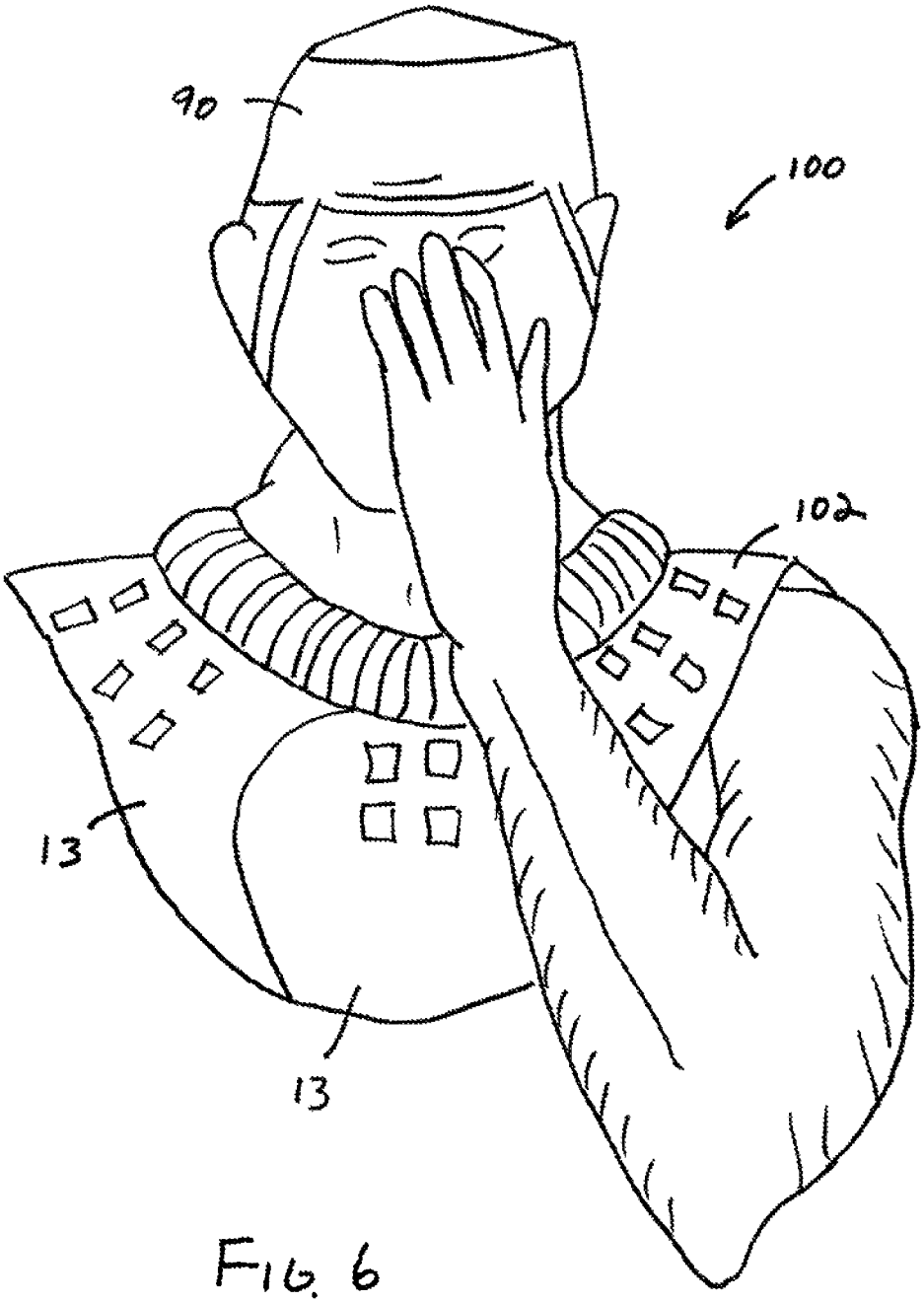
FIG. 6 is a front view of an embodiment of a shoulder pad as used in an additional exemplary embodiment of a head protection system.

Referring now to FIG. 6, the tight-fitting helmet 90 may generally have a construction that fits tightly enough to remain in place on the wearer's head during impacts on head cage assembly 14 that may be transferred to the wearer's head so that the wearer's head is biased to be configured as when the head cage assembly 14 is in the default position in a non-limiting example through the use of a non-stretch ventilating material tailored to a wearer's head shape. The tight-fitting helmet 90 may in non-limiting examples be secured to the wearer's head by straps under the jaw and chin, uncovered ears, across the base of the skull, and interlocking those straps under the ear; however, a person of ordinary skill in the art will recognize other ways in which the tight-fitting helmet 90 may be secured to the wearer's head.

Referring, back to FIG. 4C, the tether 88 is attached at and/or around the center of the wearer side of the elastomeric cap 62 and at and/or around the head rotation axis of the tight-fitting helmet 90. In embodiments, the attachments of the tether 88 may be integrally molded with the torus cushioning chamber 80, elastomeric cap 62 and the tight-fitting helmet 90, or alternately, may be detachably made using, in non-limiting, examples, an interlocking hook and loop fastener sheet, bonding, and/or adhesives. In still further embodiments, the tight-fitting helmet 90 and at least a portion of the elastomeric cap 62 may be an integral construction.

As described above, the tether 88 allows normal range of rotational movement of the wearer's head, while limiting lateral movement such that the wearer's head does not contact the head cage 14, and upon an impact or collision to the head cage assembly 14, the wearer's head and tight-fitting helmet 90 are biased toward being axially centered with the elastomeric cap 62 and the torus cushioning chamber 80 such that the torus cushioning chamber 80 may effectively cushion the impact to the top edges or crown of the wearer's head. When crown impact occurs, the tether 88 is able to be held or positioned in the tether storage area 84, such that the tether 88 itself does not create an additional source of point impact on the wearer's head where it may be transferred to the wearer's neck and spine. In a still further embodiment, a second torus chamber (not depicted) may be formed on the tight-fitting helmet 90 such as to create a still further cushioning against such impacts.

The tether 88 itself may be constructed in a variety of ways, including in a non-limiting examples tubular, unitary and/or multiple strand elastomeric constructions. A Unitary construction may be an elastomeric solid or a space matrix made of closed or open cells while other embodiments may be hollow to reduce weight and increase compressibility during an impact of collision. In multiple strand embodiments, a woven or parallel composition may be used in order to reduce weight and increase compressibility. In embodiments as disclosed in more detail herein, the tether 88 may include vents that facilitate ventilation for heat dissipation from the wearer's head.

Referring back to FIG. 1, once the head protection system 10 is assembled and configured about the head of the wearer, a tensile or other tight-fitting cover (not depicted) may be arranged over at least a portion of the head protection system 10, particularly, those portions through which the wearer would not view. Therefore, particularly the cage slat lower portions 34, and particularly the connections of the cage slat lower portion 34 to the shoulder pads 12 rigid panels 13 may be covered by such a tensile cover. Such a cover (while not depicted) can help to maintain the head protection system 10 assembled in relation to the wearer during hand fighting, in a non-limiting example. In one embodiment of use, the tensile cover is interlaceably secured above the node 20 and elastomeric mounts 18 so that these connections to the shoulder pads 12 rigid panels 13 are not detachable from hand fighting impacts, in a non-limiting example. In an embodiment, when a wearer wishes to reach their hand inside the cage assembly 14 to the face and/or neck, the tensile cover panel over the side adjacent the body centerline may be reached under through an overlap in the material and detached from connections on the cage slat lower portion 34 to loosen the cover and allow a hand to reach behind the cage slat lower portions 34 to release one or more of the mounts 18 and nodes 20, such as by releasing the T-shaped locking bar 36 of the mount 18 and then withdrawing the lower end tab 30 from a seat 28 on the mount 18.

The cage slats 32 are joined at the shoulder pads 12 rigid panels 13 at the lower end tabs 30 that are received within the seats 28 of the mounts 18 and the cage slats 32 are secured to the elastomeric cap 16 by the engagement of end tabs 58 into seats 60 of the cap 16 to create a head protection system 10 which has a default position held by the arrangement between the cage slats 32, shoulder pads 12, and cap 16, that centers the wearer view area within the head cage assembly 14. While the interaction between the cage slats 32 connected to the shoulder pads 12 rigid panels 13 at the mounts 18 and the nodes 20 and connected to the tabs 18 at the seats 60, a system of improved suspension and impact dampening is created.

FIGS. 6-11 depict another exemplary embodiment of a head protection system 100. In the foregoing description of the head protection system 100, like reference numerals to those used with respect to the embodiment described above, will be used to refer to like structures for the purpose of conciseness.

FIG. 6 is a front partial view of the bead protection system 100 including the tight-fitting cap 90 and a shoulder pad 102. The shoulder pad 102 may include a plurality of rigid panels 13, which may be exemplarily similar to athletic shoulder pad panels. The shoulder pad 102 and rigid panels 13 are shaped to conform and be securedly attached to the shape of the shoulders in a manner that permits articulation of limbs in the upper torso and a full range of aspiration. Embodiments of the shoulder pad 102 with rigid panels 13 may include mounts for additional protective panels (not shown) and may further provide secure attachment points as will be described in further detail herein or other components of the head protection system 100 as disclosed herein.

Figure 7:
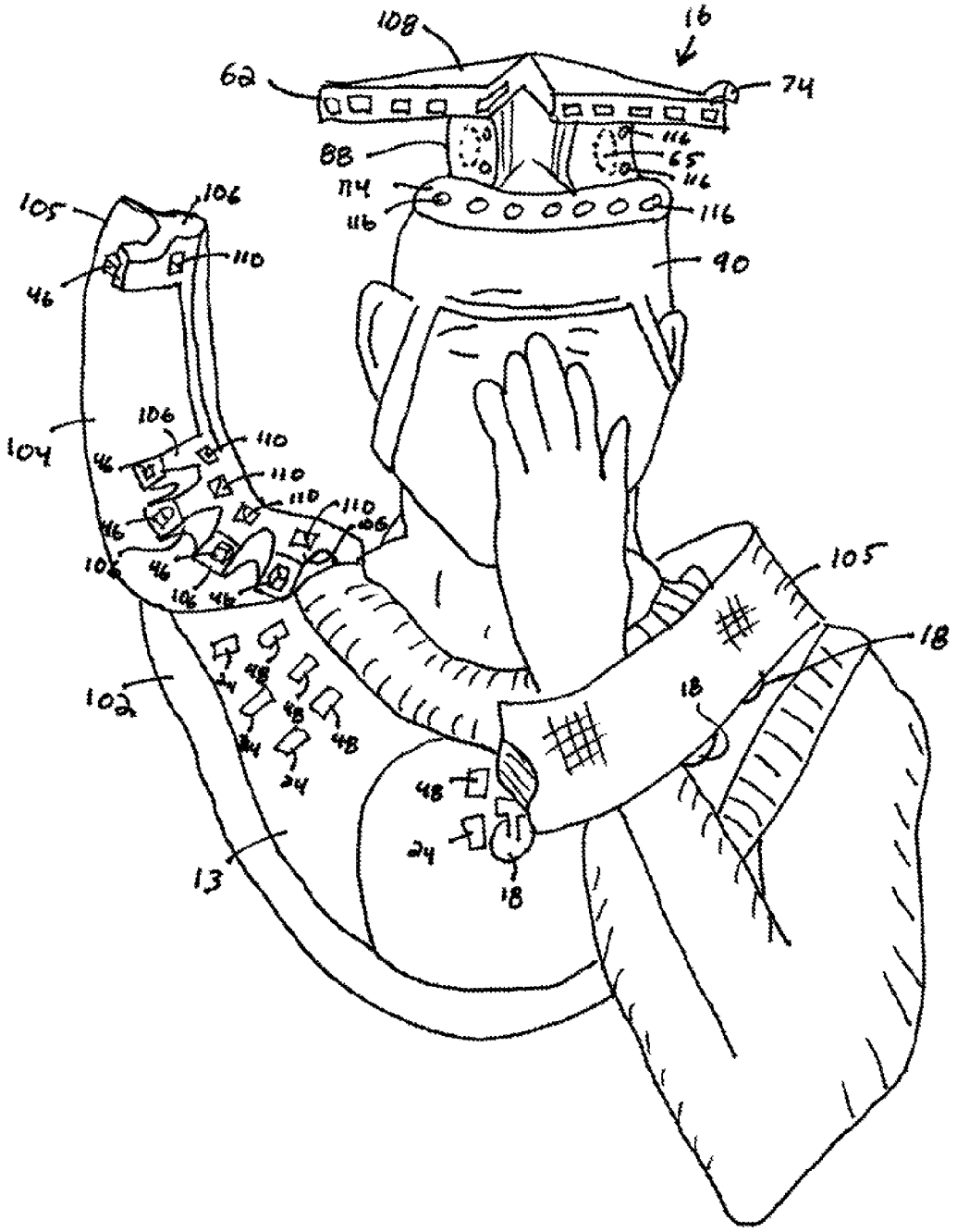
FIG. 7 is a partial front view of an additional embodiment of the elastomeric cap and cover.

FIG. 7 is a partial front view of the head protection system 100 which further depicts the cap 16 with a cutaway section 108 to depict the interior of the elastomeric cap 62. The head protection system 100 further includes an integrally-molded wide collar node structure 104 that drapes over and secures to the shoulder pad 102 rigid panels 13 at keyed node through holes 48 in the shoulder pad 102 rigid panels 13 depicted in FIG. 6. FIG. 8 is a still further partial front view of the head protection system 100, which further depicts a plurality of slats 32 mounted to the cap 16.

While the head protection system 100 as seen in FIGS. 7 and 8 depict a single mount 18 without cage slat 32, it will be appreciated by a person of ordinary skill in the art that other embodiments will include a mount 18 inserted into each of the through holes 24, as described above. The shoulder pad 102 rigid panels 13 also includes through holes 48 that are configured to receive nodes 106. While nodes as described above, particularly with respect to FIGS. 1-3D may be used, in an alternative embodiment for the node 106 may be configured to include a key hole 110 that is configured to receive the cage slat lower portion 34 of an associated cage slat (not depicted) as described herein. This is different from the node 20 described above with respect to FIG. 2 in that the node 20 includes a key 44 that corresponds to and fits within a key hole 42 found in the cage slat 32 cage slat lower portion 34.

The exact parameters of the cage slat lower portion 34 of the cage slat 32 configured to be received within the key hole 110 in the wide collar node structure 104, may be determined from material properties and configurations of reinforcing an elastomeric such as to facilitate a more secure nesting between the cage slat 32 and the key hole 110. This nesting of the cage slat lower portions 34 within the key holes 110 enable sufficient movement of the cage slat lower portion 34 to insert, and remove a hand of wearer within the head protection system 100 to facilitate tactile access to the wearer's face. This is also depicted with reference to FIG. 8.

In an embodiment, each of the nodes 106 are integrally connected to each other such as depicted in FIG. 7. In an embodiment, the nodes 106 may be resiliently connected to form a unitary integrally-molded embodiment of the wide collar node structure 104 where each of the plurality of nodes 106 corresponds to one of the through holes 48 on the shoulder pad 102 rigid panels 13. The top, or outer, portion of the collar structure 104 firms a reinforced elastomeric panel flap 105 which in an embodiment is of a uniform width around the perimeter of the wide collar node structure 104 and in a further embodiment a cross section of the wide collar node structure 104 panel flap 105 is tapered in thickness as the wide collar node structure 104 panel flap 105 progresses outwardly from the node 106 towards the mounts 18. The thinner outer perimeter of the wide collar node structure 104 panel flap 105 is therefore configured to be lifted to permit access, first to the mount 18. Then, in a region between cage slat lower portions 34 and corresponding mounts 18 and nodes 106 configured to allow passage of a user's hand to the users face, exemplarily between cage slats S5-S6 (in FIG. 8), the wide collar node structure 104 provides a larger hand passage area when needed. After removal of the user's hand from inside the head protection system 100, the wide collar node structure 104 panel flap 105 is configured to return to a default position in closer proximity to the shoulder pad 102 rigid panels 13. Embodiments may also be configured to provide a gap between the thin edge of the wide collar node structure 104 panel flap 105 and the shoulder pad 102 between mounts 18 which may enable ventilation in cooperation with voids in the collar node structure 104 which can facilitate convection to the neck and head.

The interaction between the wide collar node structure 104 and the shoulder pad 102 rigid panels 13 enables the wide collar node structure 104 panel flap 105 to be separable from the shoulder pad 102 rigid panels 13 to form a gap such that a wearer may insert his or her hand between the shoulder pad 102 rigid panels 13 and the wide collar node structure 104 panel flap 105, such as to gain tactile access to a wearer's face while the head protection system 10 is being worn.

Figure 12:
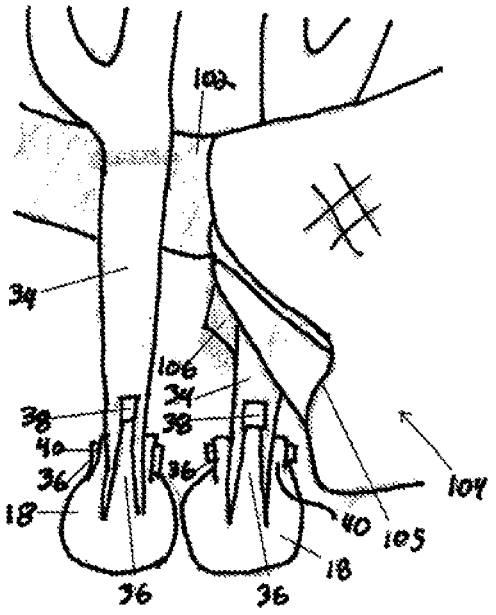
FIG. 12 is a close up view of the portion of FIG. 8 designated 12-12.

FIG. 8 is a still further partial front view of the head protection system 100, which further depicts a plurality of slats 32 mounted to the cap 16. Referring in greater detail to FIG. 8, the cage slat lower portions 34 are configured so that the cage slat lower portion 34 and the cage slat center portion 50 creates a curve and re-curve system that facilitates the suspension and dampening of impact forces on the head cage assembly 14. This further includes transitions from the uniform cage slat lower portions 34 to the cage slat center portions 50 and/or the lower end tabs 30, exemplarily on slats S1, S2, S3, S4, S5 and S6 (as denoted in FIG. 5) which serve the dual purposes of enabling, hand access to the face as described above, as well as maintaining and enhancing suspension and dampening of impact forces on the head cage assembly 14. In order to further dampen impact forces and strengthen the head cage assembly 14, portions of the cage slats 32 at predicted stress regions of the curves, particularly with the transition curves from the cage slat center portions 50 to the cage slat lower portions 34 are thickened with additional structural material. FIG. 12 is a close up view of the portion of FIG. 8 designated 12-12. FIG. 12 better depicts the connection of cage slat lower portion 34 to the mount 18. Also depicted is the relation of the panel flap 105 of the wide collar node structure 104 at a position over the mount 18 and the cage slat lower portion 34.

Figure 13A:
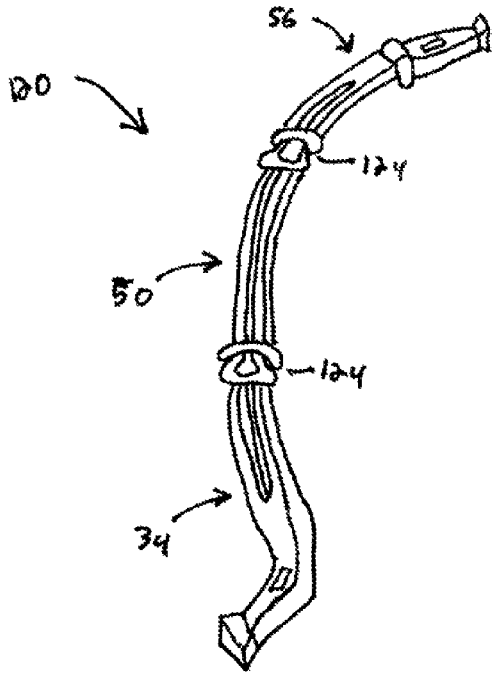
FIGS. 13A and 13B depict an alternative exemplary embodiment of a cage slat as may use with embodiments of the head protection system.
Figure 13B:
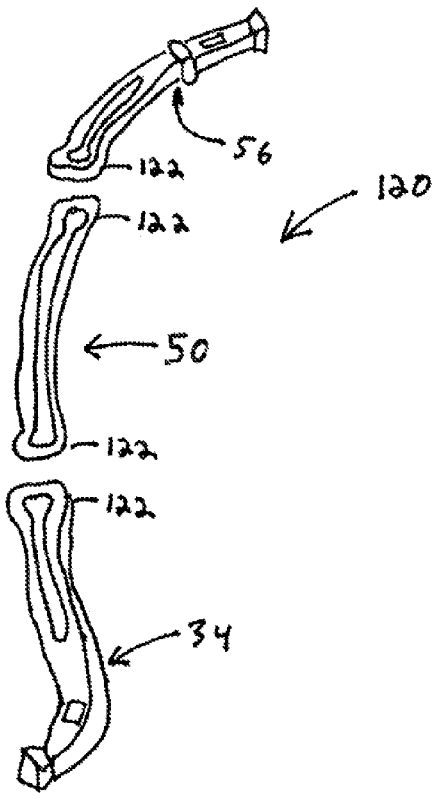

FIGS. 13A and 13B depict an alternative embodiment of the slats 120 that may be used in connection with embodiments as disclosed herein. The slats 120 are constructed of multiple interlocking sections such that the cage slat lower portion 34, center portion 50, and upper portion 56 are each separate components. FIG. 13B depicts the slat 120 in an exploded view such that each of the separate components can be seen. FIG. 13A depicts the slat 120 in a fully assembled configuration. Each of the slat portions comprises connection members 122. The connection members 122 interlock to form interlock joints 124 which secure each of the slat portions to one another.

Figure 9A:
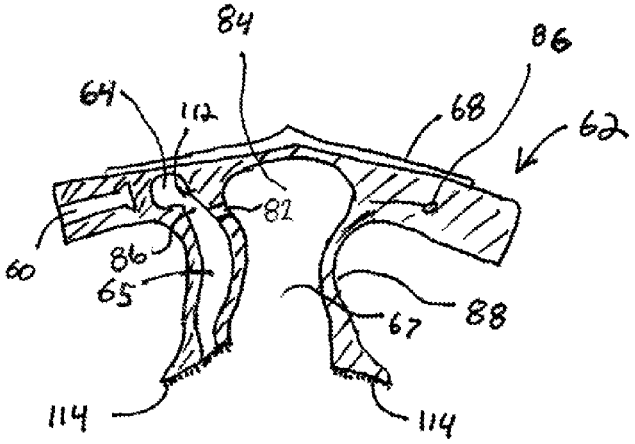
FIGS. 9A and 9B depict cross sections of exemplary embodiments of elastomeric caps.
Figure 9B:
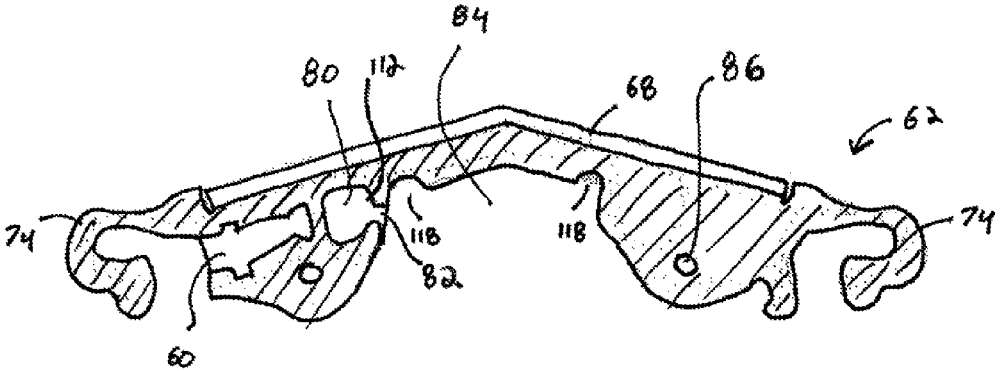
Figure 10:
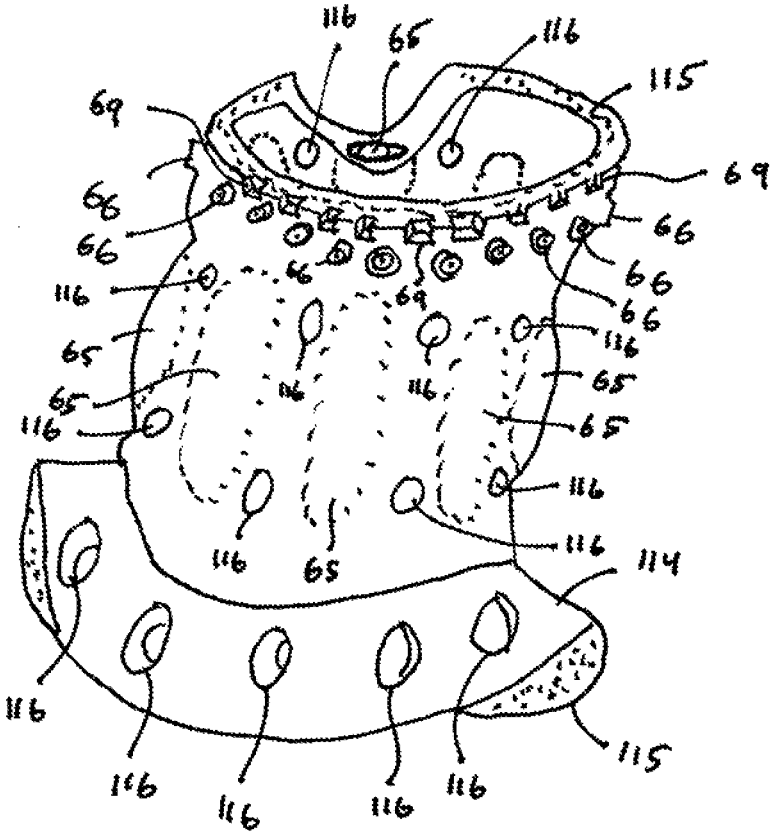
FIG. 10 depicts an exemplary embodiment of a tether.

FIGS. 9A and 9B depict sectional views of alternative embodiments of elastomeric cap 62. FIG. 10 depicts an embodiment of a tether 88. The elastomeric caps 62 depicted in FIGS. 9A and 9B further include a resilient sheet 68 as described above that serves a purpose of preventing locking or sticking of an impacting object on the crown of the elastomeric cap 62. Rather, the impacting object on the crown of the elastomeric cap is deflected away. This reduces the contact time of the impacting object with the crown of the elastomeric cap 62, which can reduce compression of the head, neck and/or spine. FIG. 9A depicts an embodiment of the tether 88 which is integrally formed to the bottom side of the elastomeric cap 62. FIG. 9B depicts an embodiment of the elastomeric cap 62 which is formed separately from the tether (not depicted) but is configured with connectors 118 which may be keyed to receive keys 69 and to secure to the tether 88 to the elastomeric cap 62 which aligns the inflate port nipples 66 of the tether 88 with the inflate ports 82 of the elastomeric cap 62.

The in embodiments depicted in FIGS. 9A and 9B, air chamber 64 includes an inflate port 86 that extends between adjacent air chambers 64, torus-shaped cushioning chamber 80 (or associated torus segment 112). The breathing port 82 and the inflate port 86 may be constructed in a similar manner, and may exemplarily include a flap or other resilient opening of elastomeric material that opens or closes in the manner as described herein depending upon the compression or impacts on the air chamber 64 and/or torus cushioning chamber 80 and/or torus segment 112. (FIG. 9) In an exemplary embodiment, under normal conditions, the breathing port 82 is generally open such that the air chamber 64 is filled with air and air may circulate within the air chamber 64. However, upon impact, the breathing port 82 closes to trap air within the air chamber 64 and as the impact is applied to the air chamber 64, the inflate port 86 opens to force the air from the air chamber 64 into the torus cushioning chamber 80 such that the torus cushioning chamber 80 inflates and creates a resilient air cushion to receive the crown of the wearer's head if the wearer's head engages the cap 16. After the impact or collision, the air retreats back through the inflate port 86 into the air chamber 64 and the breathing port 82 opens such that air can circulate in the air chamber 64.

Figure 11:
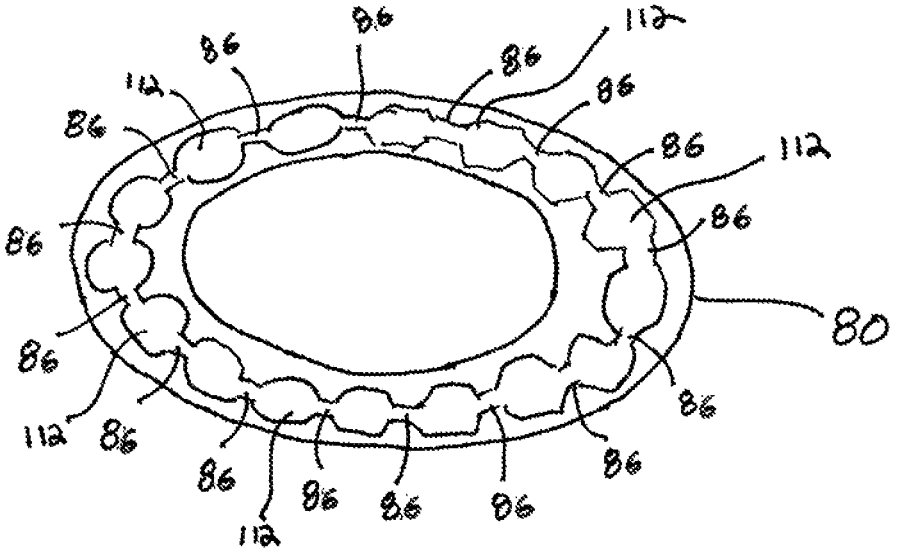
FIG. 11 depicts a cross section of an exemplary embodiment of the center of the torus-shaped cushioning chamber.

In exemplary embodiments, the tether 88, as exemplarily depicted in FIGS. 9A and 10, may be constructed of nesting tubular elastomer sleeves. Such a tether 88 may be constructed by blow-molding integrally formed with elastomeric cap 62 and torus-shaped cushioning chamber 80, or, non-limiting examples, blow-molding, thermal bonding, non-thermal welding, or cementing nesting sleeves both around the top and bottom perimeters and vertically so that localized partial air chambers 65 in the tether 88 are created with inflate port nipples 66 which correspond with inflate ports 82 of the elastomeric cap. Keys 69 engage portions of the cap 62 to align the inflate port nipples 66 with the inflate ports 82. Further embodiments include hook and loop fasteners 115 or other known connection structure to secure the tether 88 to the elastomeric cap 62 and to the tight fitting helmet 90. In a default inflated or "pillowed" position, air from the air chamber 65 is vented through the breathing ports 86 located at the top and bottom of the air chamber 65 to the tether interior 67. This causes gravity flow of atmospheric debris out of the air chamber 64 and is sized for permitting non-impact head rotation. When a sufficient impact occurs from a cage slat 32 (as depicted in FIG. 8) to the elastomeric cap 62, the elastomeric response is toward the localized section 112 of the torus-shaped cushioning chamber 80 (as depicted in FIGS. 9A, 9B, and 11) which is co-formed, or are correspondingly attached to co-form, with the air chamber 64 in the tether 88. The air closest to the impact is compressed sufficiently to constrain flow of compressed air through the breathing ports 86 located at the top and bottom of the air chamber 65, such that the air chamber 65 is pressurized during an impact which creates a more rigid co-formed structure and biases the tether 88 toward the default position of the head and neck placing the head and neck in an optimal posture. With a crown impact the top breathing ports 86 to each of the air chambers 65 are pinched shut by elastomeric resilient action forcing compressed air to the constrained flow at the lower breathing ports 86. The breathing ports 86 exhaust an from the torus-shaped cushioning chamber 80 to tether interior 67. This further facilitates head temperature control during impact and non-impact movements of head protection system 100 caused by wearer movements and protects breathing ports 86 from clogging debris from outside tether 88.

In an embodiment, the tether 88 may be secured to the tight-fitting helmet 90 by a perimeter panel 114 at the lower edge of the tether 88 the perimeter panel 114 may, for example, include hook and loop fasteners 115 which correspond to a mating hook and loop panel (not depicted) on the tight-fitting helmet 90. The perimeter panel 114 and corresponding panel on the tight-fitting helmet 90 may include vents 116 as described in further detail herein to facilitate temperature control of the person wearing the head protection system 110. Additionally, further embodiments may be made as to specifically fit for an individual, such that the slack in the fit of the tight-fitting helmet 90 is sufficient to allow non-impact rotation of the head and neck as permitted by the a more firm flexibility of the tether 88, which may relate to the number of individual an chambers 64 and vents 116 located in the tether 88, or absent an chambers 64.

FIG. 10 is a perspective view of an exemplary embodiment of the tether 88 depicting a plurality of air chambers 65 and vents 116. The vents 116 are located through the vertical bonded non-air chamber portions of the tether 88 between each of the air chambers 65 and also through the perimeter panel 114 corresponding with through vents in tight-fitting helmet 90. The vents 116 facilitate head and body temperature control by providing a path for air flow into and out of the tether interior 67 and tether storage area 84 (FIGS. 9A and 9B), and for escape of radiated heat from scalp.

In an exemplary additional feature, breathing ports 86 and vents 116 facilitate flushing with fluid for cleaning of the tether 88 and elastomeric cap 62 interior, and tether 88 air chambers 65.

In still further embodiments, due to the need for alignment and centering of the wearer's head within the head protection system 100, the head protection system 100 may be sized and dimensioned specifically to fit a wearer's head and upper body. In such embodiments, detailed measurements of the wearer's head, neck, and shoulders may be taken such that the components may be dimensioned for an optimal fit and placement within the head protection system 100.

In a still further embodiment, pressure sensors or strain gauges may be placed within various locations in the head protection system 100, such as, but not limited to, the air chamber 64, the torus cushioning chamber 80, and various places along the cage slats 32. These sensors may be connected to wireless transmitters such that the effects of collisions and impacts on the wearer and the head protection system 100 may be recorded and monitored to improve or optimize performance of the head protection system 100, as well as to gain further knowledge as to the forces applied to the wearer's head during such collisions or impacts. In still further embodiments, the readings from one or more of the pressure sensors or strain gauges may be visually presented on a graphical display secured to one or more of the components of the head protection system 100.

Figure 14:
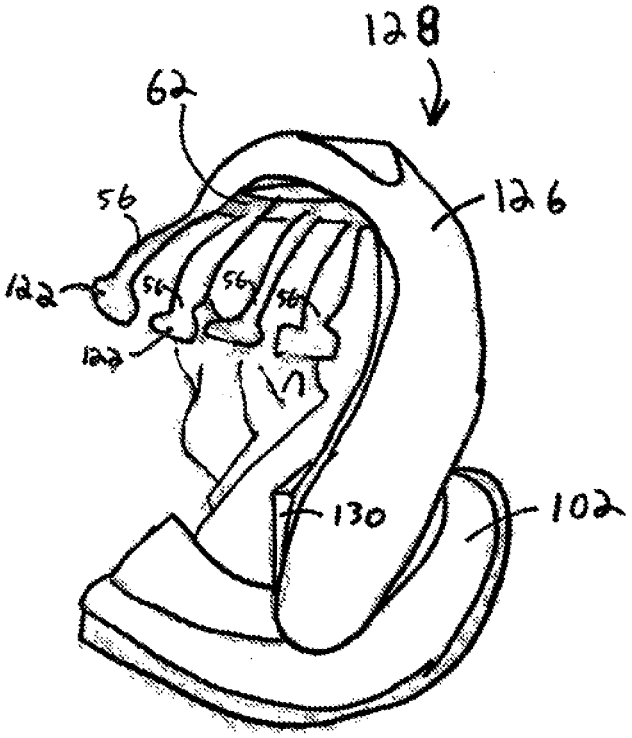
FIG. 14 depicts a still further exemplary embodiment of a head protection system.

In still further embodiments which may exemplarily be used in military applications, modifications may be made while remaining within the scope of the present disclosure in order to facilitate additional considerations such as armor or increased vision and sound paths such that the wearers senses are not impaired by the head protection system. FIG. 14 depicts an exemplary alternative embodiment of the head protection system 128. In the head protection system 128, a curved single-piece armor ridge 126 transfers weight from the full array of slats, represented by upper slat portions 56, to the two heavy slats (S25 and S26, depicted in FIG. 5). It will be understood that in embodiments, entire slats may be used and the only upper slat portions 56 are depicted to facilitate view of the components of the embodiment. The armor ridge 126 extends vertically up from the shoulder pad 102 and cantilevers over the cap 62. In an embodiment, the armor ridge 126 may include a storage area 130, in which additional cargo, e.g. battery packs, may be stored. The additional weight of this cargo can further facilitate and supplement the weight of the armor ridge 126, such that the armor ridge 126 will balance the weight of the cap 62 and slats 56 to maintain the optimal posture of the head and neck for maximum impact deflection. In computer or electronics enabled embodiments, the battery packs may provide the power source.

In embodiments, the holes through the S25 and S26 cage slats provide keyed anchors for the armor ridge piece to be mechanically attached with a stiff, but lightweight corresponding keyed foam shim that positions the S25 and S26 cage slats relative to a back panel of the shoulder pad 102.

This may be achieved by using screws through the shim and the holes through the S25 and S26 cage slats to embedded studs in the armor. The vertical portion of the armor ridge piece attaches approximately parallel to the S25 and S26 slats and curves and extends forward, creating a thicker raised ridge over the top of the cantilevered cap 62 to the forward edge of the cap 62. There, under a small overlap of the front edge of the armor ridge, are embedded studs for a screw-mounted bracket with two slat tab ends integrally attached to the bracket which fit into corresponding chambers in the front of the cap 62, which lock the cap 62 under the armor ridge 126.

Figure 15:
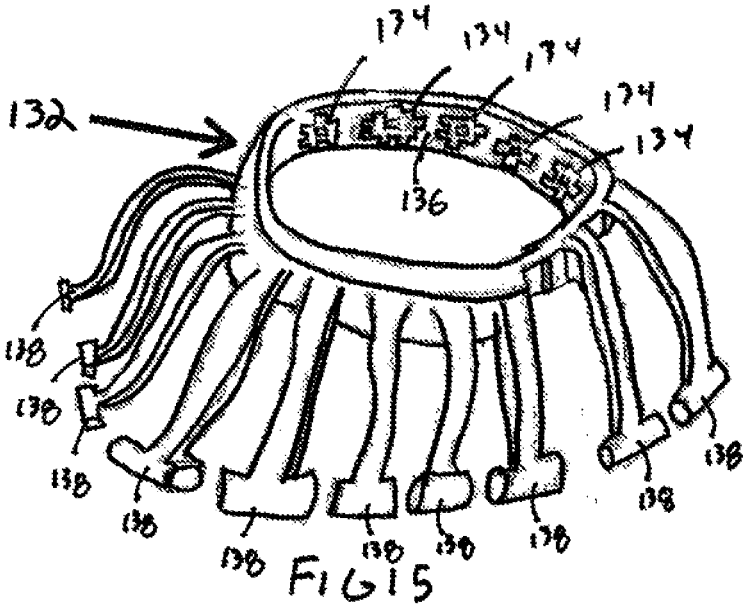
FIG. 15 depicts an exemplary embodiment of an outer band as may be used in conjunction with the embodiment of the head protection system depicted in FIG. 14.

In an embodiment depicted in FIG. 14, a partial array of upper slat portions 56, which exemplarily include connection members 122, extend from the elastomer cap 62 as described above and extend from under armor ridge 126. In an embodiment, the cage slat upper portions 56 mount to the elastomer cap in a seat as described above, an elastomeric support (not depicted) is fixed to the underside of the armor ridge 126 with a key hole which may be similar in construction to collar node key hole 110, described above. Due to the cantilevered configuration and support from the armor ridge 126, the cap 62 must be modified with a relatively stiff reinforced elastomeric partial-circle outer band 132, depicted in FIG. 15. This creates additional radial space from the cap 62 in such that the lower portions (not depicted) of the cage slats can secure to the shoulder pad 102 while having sufficient clearance from the head and face of the wearer. The outer band 132 with molded grooves 134 on an inside surface 136. The molded grooves correspond both to interlocked loops and single loop ends attached by keyed portions in center of back to shim and S25 and S26, and attached to the vertical portion of the armor ridge by longer screws. Molded in outer band 132 is system of locking t-bar tethers 138 with longer tethers that previously disclosed embodiments that allow two wraps of tether 138 around the band 132 before locking. At the front ends of the outer band 132, when not attached to the slat portions, the tethers may be wrapped and the unused portion of the bands folded up for attachment to the armor ridge 126. A separate inner reinforced elastomeric band corresponding to inner edge of outer band, further secure interlocked loops from disengaging after the tether wrap, and further assist in maintaining the lower ends of slat upper portions in optimal position. Field re-configuration of full cages using interlocking slat portions for attachment of heavier full-face protection armor requires a full circle of outer and inner bands. With an armor ridge and slat upper portions resiliently secured in place to form framework, armor anti-penetration systems may be attached.

Figure 16:
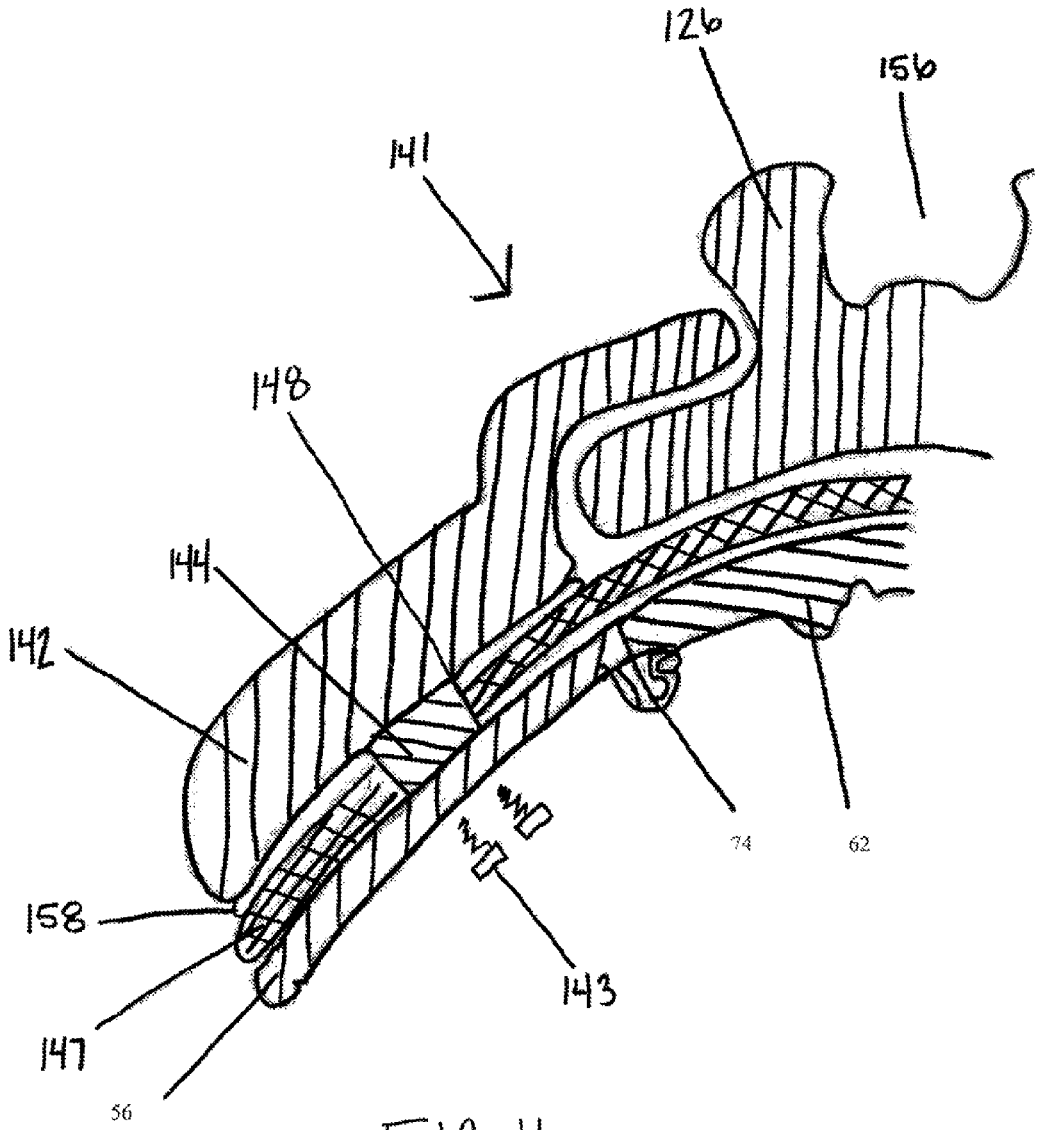
FIG. 16 depicts an exemplary embodiment of an upper armor system.

FIG. 16 depicts an upper armor system 141, as described in further detail herein, applied below and adjacent to armor ridge 126 and attached to slats (upper slat portions 56) at inner armor 147 through holes 148.

In order for the framework of slats (e.g. 32) of slat portions (e.g. 56) secured by resilient elastomerics (e.g. 62) to absorb significant portion of impacts on outer layer of armor plates 142 by deforming from default position, components of the armor must be attached to components of the framework so as to have ability for constrained, limited movement in cooperation with framework upon impact prior to impact forces reaching head. Armor plates 142 are cursedly shaped to a corresponding spherical arc section of the slat framework. The armor plates 142 are secured to the slat framework in an interlocking array. The armor plates are attached to the reinforced portion of cage slat ribs, or to both ribs of a slat 32 with screws 143 or other fasteners secured into studs (not depicted) embedded in elastomeric stand-off stems 144 bonded to an underside of armor plate 142. This enables armor plate 142 rotation from angular impact in addition to brute deflection of armor plate hardness, and as also allowed by edge joining (not depicted) of armor plates 142.

The edge joining of the armor plates 142 must allow some rotation of individual armor plates, while preventing penetration of armor system 141 by individual ballistic-speed projectiles. Part of accomplishing this is by having the elastomeric stand-off stem 144 engineered to minimize movement of armor plate 142 out of a spherical layer of the armor plate, thus preventing a projectile from getting under a plate edge and leveraging armor plates 142 away from their default positions. In an embodiment, edge joinings are covered with another layer of armor plate, either a raised flap on armor plates that covers edge joinings, or by having edge joinings include opening that allow another, appropriately longer, elastomeric stem 144 to be attached to underlying slats and attaching a second layer of armor plates which cover inner layer edge joinings.

By having a system of armor plates 141 tightly constrained and tailored in their impact reaction movements, impact damage to armor plates 142 is reduced, allowing multi-impact uses, and, should penetrating hardened rifled slugs get under armor layers 142, they would be clamped between armor layers, as a football receiver stops the rifling of a throw by grabbing the spinning ball.

To add a final protective layer to the system 141 to prevent any penetration under the layer of armor plate 142 an even thickens layer of woven ballistic fiber packet 158 encapsulating hex plugs with a taper defined by spherical layer radius, is packed tightly enough to require lateral compaction of entire layer of tapered hex plugs to penetrate, and has through holes 148 allowing passage of armor plate stems 144 to underlying reinforced attachments on slats 32, so as to hold inner armor 147 in place. A further embodiment of the system 141 includes a mount 156 for an electronics package in the armor ridge 126.

This active armor system 141 absorbs and deflects impacts partially through allowing deflecting armor component movements relative to each other, through an increasing resistance dynamic impact absorption system. Another description is a tailored resilient intentional crumple zone capable of withstanding multiple impacts that temporarily dislocate system from default position.

Figure 17:
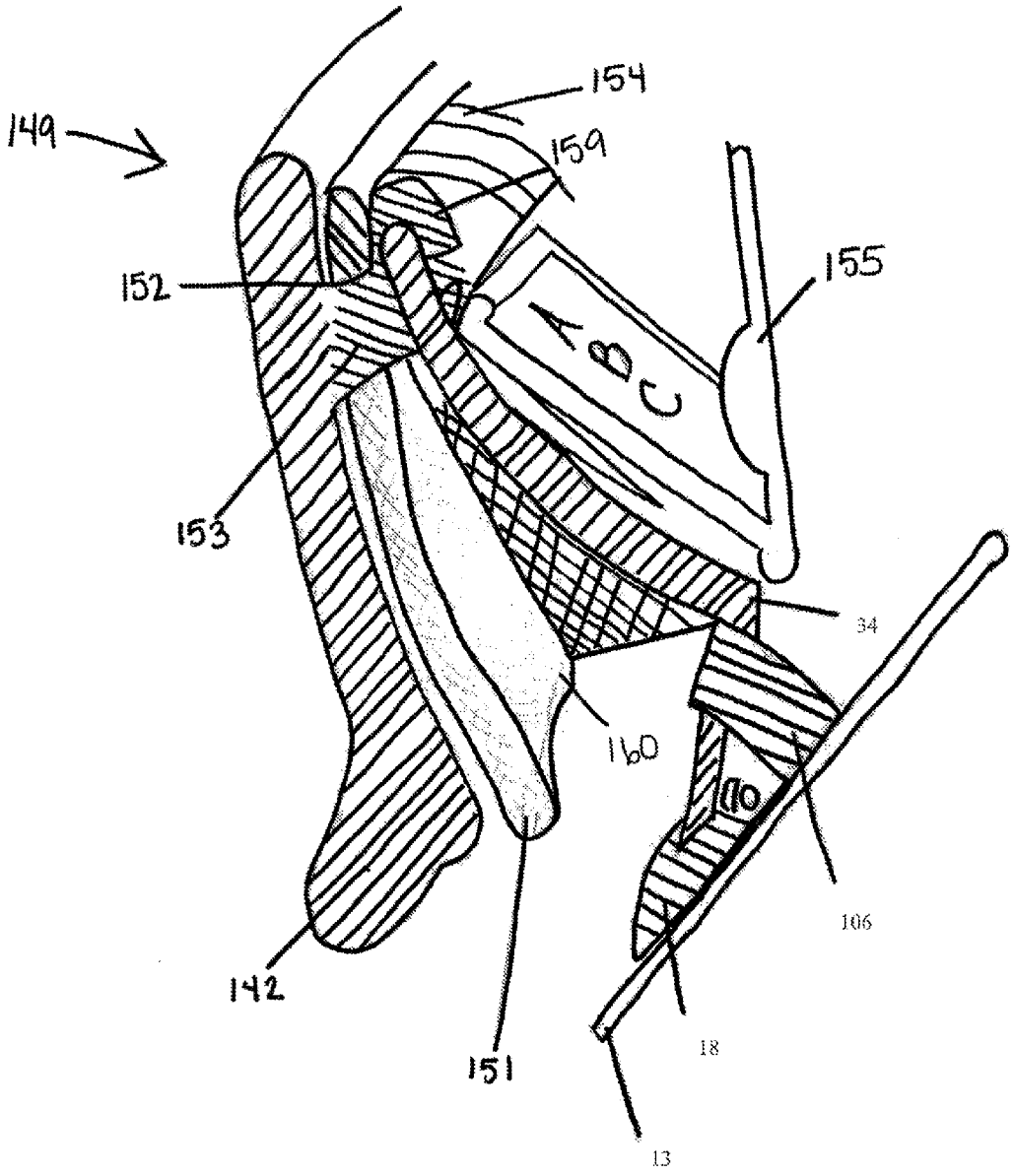
FIG. 17 depicts an exemplary embodiment of a lower armor system.

FIG. 17 depicts lower armor system 149 applied to cage slat lower portions 34, with armor plate attached by stem 153 integrally cooperating with lower outer and inner bands 150 secured together at lower inner armor 151 through hole 152 with lashing 154. Lower inner armor 151 is attached to lower outer and inside bands 150 by stem 153 and is comprised of spherical arc section overlapping panels connected by lower inner armor layer 147 material pressed flat and with folded pleat 160 so that wearer may pivot lower armor system 149 bottom away from shoulder pad panel 13 so as to allow debris behind lower armor system 149 to fall out by gravity. An electronics package 155 is nested in shrouded area between lower armor system 149 and shoulder pad panel 13 to allow viewing by wearer only, or to be removed on tether for normal viewing. In a non-limiting embodiment, the electronics package 155 is a tethered damshell-type electronics platform.

This written description uses examples to disclose the invention, including the best mode, and also to enable any person skilled in the an to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A head protection system, comprising:

at least one shoulder pad configured to secure to shoulders of a wearer;

an elastomeric cap configured to be held in a position relative to a crown of the head of the wearer;

comprising a torus-shaped cushioning chamber adapted to be positioned between an outer surface of the elastomeric cap and the head of the wearer;

a plurality of cage slats that extend between the at least one shoulder pad and the elastomeric cap, the plurality of cage slats maintain the elastomeric cap in the position relative to the crown of the head of the wearer and protect the head of the wearer from impact, wherein each of the plurality of cage slats comprise an upper portion configured to secure to the elastomeric cap, a lower portion configured to secure to the at least one shoulder pad, and a center portion configured to protect the head of the wearer;

a plurality of mounts, each mount of the plurality configured to secure an end of the lower portion of one of the plurality of cage slats to the at least one shoulder pad, wherein each mount of the plurality of mounts receives an end of a lower portion of a cage slat, and each mount comprises a locking bar that resiliently extends through a slot in the lower portion of the cage slat; and a plurality of nodes, each node of the plurality configured to secure the lower portion of one of the plurality of cage slats to the at least one shoulder pad.

2. The head protection system of claim 1, wherein the plurality of cage slats are disposed circumferentially about an outer edge of the elastomeric cap.

3. The head protection system of claim 1, further comprising a tight-fitting helmet securely worn about the head of the wearer, the tight-fitting helmet disposed within the plurality of cage slats.

4. The head protection system of claim 3, further comprising a tether that resiliently secures the tight-fitting helmet to an inner surface of the elastomeric cap.

5. The head protection system of claim 1, wherein each of the plurality of cage slats extend between the shoulder pads and the elastomeric cap in a recurved shape.

6. The head protection system of claim of claim 1, wherein the lower portion of each of plurality of cage slats comprises a slot and each node of the plurality of nodes comprises a projection configured to be received within the slot in the lower portion of one of the plurality of cage slats.

7. The head protection system of claim 1, further comprising a collar structure that comprises at least one of the plurality of nodes and secures to the at least one shoulder pad at a position sandwiching the plurality of mounts and the plurality of nodes between the collar structure and the at least one shoulder pad.

8. The head protection system of claim 1, further comprising a resilient sheet secured to a crown of the outer surface of the elastomeric cap.

9. The head protection system of claim 1, further comprising a plurality of resilient panels secured about the at least one shoulder pad.

10. A head protection system, comprising:

at least one shoulder pad configured to secure to shoulders of a wearer;

an elastomeric cap configured to be held in a position relative to a crown of the head of the wearer;

comprising a torus-shaped cushioning chamber adapted to be positioned between an outer surface of the elastomeric cap and the head of the wearer;

a plurality of cage slats that extend between the at least one shoulder pad and the elastomeric cap, the plurality of cage slats maintain the elastomeric cap in the position relative to the crown of the head of the wearer and protect the head of the wearer from impact; and a plurality of radially extending air chambers within the torus-shaped cushioning chamber, each of the plurality of radially extending air chambers comprises at least one breathing port that operates to be biased open to permit air flow into and out of the air chamber in a normal condition and the port operates to seal off the air chamber, trapping air inside the air chamber upon an impactive force applied to the elastomeric cap.

11. A head protection system, comprising:

at least one shoulder pad configured to secure to shoulders of a wearer;

an elastomeric cap configured to be held in a position relative to a crown of the head of the wearer;

comprising a torus-shaped cushioning chamber adapted to be positioned between an outer surface of the elastomeric cap and the head of the wearer;

a plurality of cage slats that extend between the at least one shoulder pad and the elastomeric cap, the plurality of cage slats maintain the elastomeric cap in the position relative to the crown of the head of the wearer and protect the head of the wearer from impact, wherein each of the plurality of cage slats comprise an upper portion configured to secure to the elastomeric cap, a lower portion configured to secure to the at least one shoulder pad, and a center portion configured to protect the head of the wearer;

a plurality of mounts, each mount of the plurality configured to secure an end of the lower portion of one of the plurality of cage slats to the at least one shoulder pad; and a plurality of nodes, each node of the plurality configured to secure the lower portion of one of the plurality of cage slats to the at least one shoulder pad.

12. The head protection system of claim 11, wherein the plurality of cage slats are disposed circumferentially about an outer edge of the elastomeric cap.

13. The head protection system of claim 11, further comprising a tight-fitting helmet securely worn about the head of the wearer, the tight fitting helmet disposed within the plurality of cage slats.

14. The head protection system of claim 13, further comprising a tether that resiliently secures the tight-fitting helmet to an inner surface of the elastomeric cap.

15. The head protection system of claim 11, wherein each of the plurality of cage slats extend between the shoulder pads and the elastomeric cap in a recurved shape.

16. The head protection system of claim of claim 11, wherein the lower portion of each of plurality of cage slats comprises a slot and each node of the plurality of nodes comprises a projection configured to be received within the slot in the lower portion of one of the plurality of cage slats.

17. The head protection system of claim 11, further comprising a resilient sheet secured to a crown of the outer surface of the elastomeric cap.

18. The head protection system of claim 11, further comprising a plurality of resilient panels secured about the at least one shoulder pad.

* * * * *